United States Patent [19]

Mauriello

[11] 3,978,637

[45] Sept. 7, 1976

[54] METHOD AND APPARATUS FOR MAKING PACKET ASSEMBLIES

[75] Inventor: Francis G. Mauriello, Malden, Mass.

[73] Assignee: Diamond Crystal Salt Company, St. Clair, Mich.

[22] Filed: Oct. 24, 1975

[21] Appl. No.: 625,523

[52] U.S. Cl. ..... 53/28; 53/29; 53/180 R; 53/183; 156/304; 156/545; 156/555

[51] Int. Cl.[2] ..... B65B 9/04; B65B 43/06

[58] Field of Search ..... 53/28, 29, 30 R, 180 R, 53/183, 184 R, 185, 187, 202; 156/290, 304, 544, 545, 553, 554, 555

[56] References Cited

UNITED STATES PATENTS

| | | | |
|---|---|---|---|
| 2,544,020 | 3/1951 | Hoag | 53/29 X |
| 2,566,533 | 9/1951 | Poux | 53/29 |
| 2,669,814 | 2/1954 | Hoag | 53/29 |
| 2,826,020 | 3/1958 | Hoag | 53/28 |
| 3,199,551 | 8/1965 | Hall et al. | 53/183 X |

*Primary Examiner*—Robert L. Spruill
*Attorney, Agent, or Firm*—Harness, Dickey & Pierce

[57] ABSTRACT

A method and apparatus for making disposable dispensing packet assemblies in which a plurality of continuous ribbons are formed, each comprised of a plurality of interconnected individual packets disposed at longitudinally spaced fixed intervals therealong, whereafter the ribbons are oriented with their respective longitudinal side edges in substantially parallel adjacent relationship and with the individual packets of each ribbon disposed in aligned transverse relationship. The axially and transversely aligned ribbons are bonded into a composite ribbon, which thereafter is transversely severed into individual sections comprising interconnected dispensing packets, each containing a selected condiment or the like.

9 Claims, 14 Drawing Figures

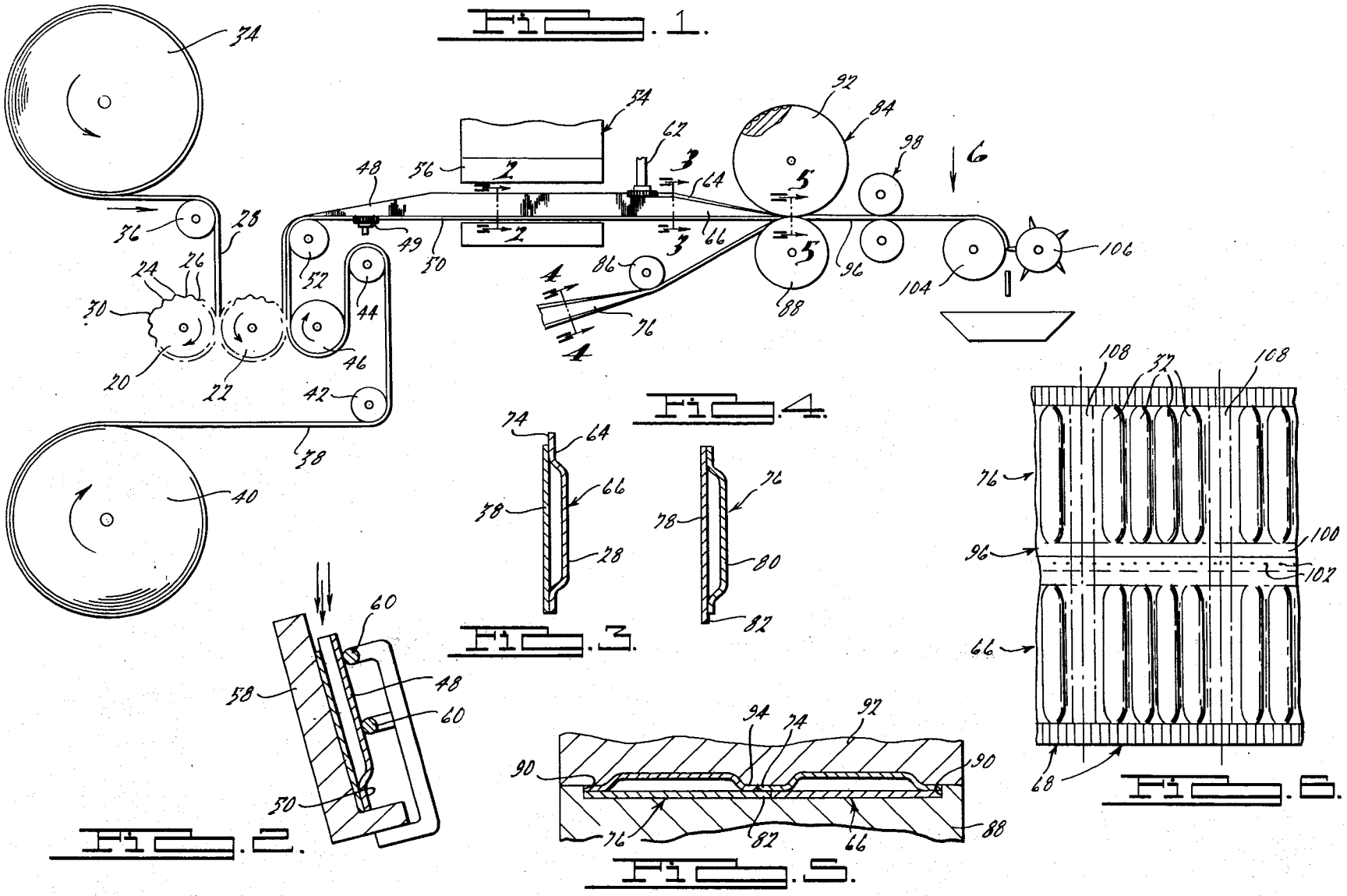

METHOD AND APPARATUS FOR MAKING PACKET ASSEMBLIES

BACKGROUND OF THE INVENTION

Disposable dispensing packets or portion control items are in widespread use in food service systems, such as restaurants, fast-food and carry-out establishments, hospitals, institutions and the like. Such disposable dispensing packets are constructed of a low-cost material, such as paper and/or plastic, and contain a normal individual serving of condiments, such as salt, pepper, sugar, sugar substitute, salt substitute or the like. The particular number and combination of packets will vary from meal to meal and whether or not an individual is under special diet restrictions, such as patients in hospitals or institutions, whereby the condiments placed on their meal trays are controlled by the particular dietary program prescribed. For example, patients in hospitals and other institutions may be subject to dietary programs which provide a salt-free or sugar-free diet in lieu of normal diets, whereby salt substitutes and sugar substitutes, respectively, are placed on the patient's tray. To facilitate the dispensing of appropriate diets for various patients, color-coding systems have been adopted for each particular diet to increase the speed and efficiency in meal services as well as assuring the correct diet for each individual.

It has been customary to assemble the desired number and combination of disposable packets in an envelope which may additionally contain supplemental eating utensils, such as plastic forks, knives, spoons, napkins, drinking tubes, and the like, to facilitate handling by food service personnel. The envelopes ordinarily are of a transparent material, such as cellophane, to enable visual inspection of the contents of each envelope.

While dispensing systems of the foregoing type have found widespread acceptance in many meal service operations, there has been an increasing need for assemblies of portion control items which still further facilitate meal service handling operations, which are of relatively low cost, and which assure that the proper type and combination of disposable packets have been dispensed. The apparatus and process of the present invention overcomes many of the disadvantages of prior art systems in providing an assembly of interconnected packets which can be quickly and simply separated by the ultimate user at the time of use for dispensing the contents thereof. The interconnected packet assembly further assures the correct combination of packets for a particular meal or dietary program, facilitates handling due to its unitary structure and further prevents inadvertent loss of individual packets during the food serving operation. The interconnected nature of the packet assembly obviates the necessity, in most instances of employing a separate envelope and the manner of producing the packets provides for further economies due to its simplicity, adaptation to high-speed mass production techniques, efficiency and optimum utilization of raw materials.

SUMMARY OF THE INVENTION

The benefits and advantages of the present invention are achieved in accordance with the apparatus aspects thereof by a mechanism including a plurality of packet forming means each adapted to form a substantially continuous web comprised of two strips disposed in face-to-face bonded relationship defining a plurality of cavities disposed at fixed longitudinally spaced intervals therealong. The cavities of each web are filled with a selected material, such as a pulverant condiment, and the web is sealed along the lateral edges thereof, forming a continuous ribbon of interconnected packets. Guide means are provided for orienting two or more continuous ribbons in axial alignment, wherein the lateral edges thereof are disposed in proximate relationship and synchronizing means are provided for transversely orienting individual packets of each ribbon in appropriate transverse alignment. The axially and transversely aligned ribbons are thereafter bonded along the lateral edges thereof, forming a composite ribbon which thereafter is severed into individual sections, comprising a plurality of individual interconnected dispensing packets.

In accordance with a preferred embodiment, each ribbon is formed such that one of the facing strips thereof projects beyond the opposed strip and means are provided for aligning the projecting edge portions in overlapping relationship, whereafter adjoining ribbons are bonded by a heat sealing of the projecting overlying face surfaces. The composite ribbon is further preferably provided with perforations along the bonded lateral edges to facilitate subsequent separation of the interconnected packets at the time of ultimate use.

In its method aspects, the present invention provides for a simple, efficient, versatile and economical method for forming disposable dispensing packet assemblies comprised of a preselected number of individual packets containing a selected combination of condiments in accordance with a desired or prescribed dietary program.

Further benefits and advantages of the present invention will become apparent upon a reading of the description of the preferred embodiments taken in conjunction with the accompanying drawings.

BRIEF DESCRIPTION OF THE DRAWINGS

FIG. 1 is a schematic side elevational view of an apparatus for making dispensing packet assemblies in accordance with one embodiment of the present invention;

FIG. 2 is a magnified transverse vertical sectional view of the web during the filling operation as shown in FIG. 1 and taken substantially along the line 2—2 thereof;

FIG. 3 is a transverse vertical sectional view through the filled and sealed web as shown in FIG. 1 and taken substantially along the line 3—3 thereof;

FIG. 4 is a vertical transverse sectional view through a second filled and sealed web prior to its bonding to the first web in accordance with the arrangement as shown in FIG. 1 and as taken substantially along the line 4—4 thereof;

FIG. 5 is a fragmentary transverse vertical sectional view through the synchronizing and bonding roll assembly shown in FIG. 1 and taken substantially along the line 5—5 thereof;

FIG. 6 is a magnified plan view of the composite ribbon as viewed in the direction of the arrow indicated at 6 in FIG. 1;

DESCRIPTION OF THE PREFERRED EMBODIMENTS

Figure 7:
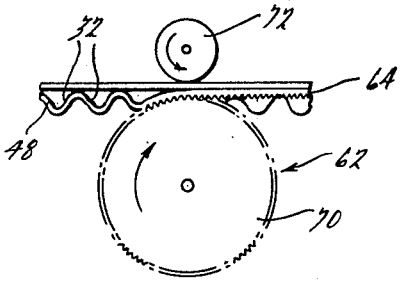
FIG. 7 is a magnified fragmentary plan view of the crimping wheel assembly shown in FIG. 1.

Referring now in detail to the drawings and as may be best seen in FIG. 1, an apparatus for forming a continuous ribbon of sealed interconnected packets includes a pair of forming rolls 20, 22, which are mounted for rotation about spaced parallel axes and which are provided around the periphery thereof with a series of circumferentially spaced axially extending conjugate projections 24 and recesses 26, which are generally of a semi-circular cross section and effect an embossment of a strip 28 passing therebetween. The projections and recesses are arranged in a series usually ranging from about 2 to about 6 and are separated by arcuate portions 30 so as to form planar sections in the strip 28 along which the continuous ribbon is adapted to be subsequently severed, forming the interconnected packet assemblies. The recesses 26 and projections 24 of the two forming rolls are disposed in conjugate meshing relationship and in accordance with the specific embodiment shown, are adapted to impart a series of four flutes 32 (FIG. 6) between each planar section, defining a cavity adapted to be filled with a material to be dispensed.

The strip 28 is continuously unwound from a feed roll 34 and passes over a guide roll 36 before entering the bight portion of the forming rolls. A second backing strip 38 is continuously unwound from a feed roll 40 and passes around an idler roll 42 and around a dancer roll 44 for maintaining an appropriate tension on the strip, whereafter it passes around a cooperating roll 46 which is disposed in rolling engagement with the periphery of the forming roll 22. The fluted strip 28 and the backing strip 38 are positioned in face-to-face relationship on passing through the bight portion of the forming roll 22 and cooperating roll 46 and are bonded together forming a series of cavities disposed at fixed longitudinally spaced intervals defining a continuous web 48.

A tenacious bonding of the two strips in face-to-face relationship can be achieved by a suitable adhesive, and preferably, by heat sealing the two strips together. In the latter event, the opposed surfaces of the continuous strips 28, 38 are provided with a thin coating of a suitable thermoplastic resin, such as polyethylene or polyvinyl chloride, for example, which upon coming in contact with the heated forming roll 22 and cooperating roll 46 are heat softened, providing mutual adherence between the face surfaces of the strips which on subsequent cooling, form a tenacious bond. In the embodiment shown in FIG. 1, the forming roll 22 and cooperating roll 46 can be provided with a crimping flange along one side thereof, or alternatively, a crimping wheel assembly 49 is provided to effect a heat sealing and bonding of one lateral edge of the continuous web, forming a longitudinally extending seal 50, as indicated in FIG. 1 and FIG. 2.

The web 48, upon emergence from the bight section of the forming roll 22 and cooperating roll 46, passes over a guide roll 52 and thereafter is oriented in a substantially upright position, as shown in FIGS. 1 and 2, and passes beneath a filler mechanism 54 in which an appropriate quantity of a filler material is introduced into the four-fluted cavity of each of the packets corresponding to a normal serving. A filler mechanism particularly suitable for this purpose is described in U.S. Pat. No. 3,199,551, granted Aug. 10, 1965, which is assigned to the same assignee as the present invention. In accordance with the mechanism as disclosed in the aforementioned patent, the subject matter of which is incorporated herein by reference and to which reference is made for further specific details of the filler mechanism, a curtainous stream of a granulated or pulverant filler material, such as salt, pepper, salt substitute, sugar substitute, sugar or the like, is ejected from a longitudinal aperture formed in the base of a hopper 56 which is provided with a rotatable feeder shaft (not shown). The curtainous stream, as indicated by the arrows in FIG. 2, is oriented to enter the open ends of the flutes of the web 48, effecting a controlled filling thereof. The web 48 is supported in a guide shoe 58 and is retained with the backing strip thereof in sliding contact by means of guide rods 60. The quantity of material introduced into the flutes is controlled by the speed of travel of the continuous web, the length of the longitudinal aperture in the base of the hopper 56 and the speed of rotation of the feeder shaft.

Upon passing beyond the filler mechanism 54, the upper lateral edge of the web 48 is sealed by means of a crimping wheel mechanism 62, as best seen in FIG. 7, producing a longitudinally extending sealing band 64 as shown in FIG. 3, producing a continuous ribbon 66 comprised of a plurality of packets 68 disposed at fixed longitudinally spaced intervals therealong. The crimping wheel assembly 62, as shown in FIGS. 1 and 7, comprises a heated crimping wheel 70 having a serrated periphery and a heated backing roll 72 which engage and compress the upper edge of the web 48, effecting a heat sealing thereof along the sealing band 64.

In accordance with a preferred embodiment, the width of the continuous strips 28 and 38 are controlled so as to provide a projecting portion along one edge thereof which is adapted subsequently to be disposed in overlying relationship with a corresponding projecting section of a second continuous ribbon, enabling a heat sealing of the two ribbons together. Accordingly, as best seen in FIG. 3, the fluted continuous strip 28, after heat sealing of the filled packets, includes a longitudinally extending projecting edge 74 along the upper edge thereof, which extends beyond the edge of the backing strip 38. A second continuous ribbon 76 which can be formed in a manner similar to the ribbon 66 is comprised of a backing strip 78 and a fluted facing strip 80, which are of different widths such that the backing strip 78 projects beyond one edge of the fluted strip 80, providing a projecting edge 82 along one longitudinal edge of the ribbon 76.

As shown in FIGS. 1 and 5, the ribbon 66, after passing beyond the crimping wheel mechanism 62, is oriented in a horizontal position and passes into the bight section of a bonding roll assembly 84. The second continuous ribbon 76 passes under a guiding and tensioning roller 86 and also enters the bight portion of the bonding roll assembly 84 in side-by-side lateral edge abutting relationship with the ribbon 66. As best seen in FIG. 5, the projecting edge 82 of the second continuous ribbon 76 is disposed in underlying relationship with respect to the projecting edge 74 of the ribbon 66, whereupon a heating of the plastic coated surfaces by the roll assembly 74 effects a heat sealing of the two ribbons together.

As will be noted in FIGS. 1 and 5, the lower roll 88 of the bonding roll assembly is formed with side flanges, indicated at 90, which are adapted to engage the outer lateral edges of the two ribbons maintaining them in appropriate side-by-side relationship with the projecting edges in overlying disposition. The upper roll 92 of the bonding roll assembly is formed with a series of projections and recesses along the periphery thereof corresponding to those of the forming rolls 20, 22, which are adapted to be disposed in conjugate relationship with the fluted embossed pattern on the surfaces of each of the continuous ribbons, thereby effecting a synchronization of the travel of the ribbons between the bonding roll assembly and assuring that the packets of one ribbon are in appropriate transverse alignment with the packets in the adjacent ribbon. The upper roll 92 is also provided with an annular rib or rim 94 extending around substantially the midpoint thereof, which is adapted to engage and compress the overlying edge portions effecting a heat sealing thereof.

The resultant composite ribbon, indicated at 96 in FIG. 1, upon emergence from the bonding roll assembly, preferably passes between a perforating roll assembly 98, wherein the central longitudinally extending sealing band 100, as best seen in FIG. 6, is provided with a plurality of perforations 102 to facilitate separation of the interconnected packets at the time of ultimate use. The composite ribbon 96, as shown in FIGS. 1 and 6, thereafter passes over a backing roll 104 and is transversely severed by means of a cutter roll 106 into individual sections at substantially the midpoint of the transversely extending sealing bands 108 along the dotted lines indicated in FIG. 6. Each severed section comprises a packet assembly composed of two interconnected packets, each containing a desired condiment.

Figure 8:
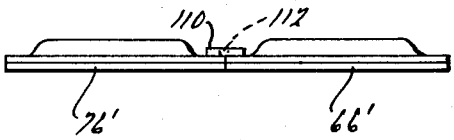
FIG. 8 is a fragmentary transverse sectional view of a packet assembly in accordance with an alternative embodiment of the present invention.

It will be appreciated that in accordance with the embodiment as illustrated in FIGS. 1-7, three, four or more continuous ribbons can similarly be bonded in side-to-side relationship, forming a transverse section or strip comprised of three, four or more individual packets interconnected along their lateral edges to provide a desired combination of condiments consistent with the intended meal service. It will also be appreciated that in lieu of a heat sealing of the projecting edge portions of adjacent ribbons to each other in accordance with the arrangement previously described, the ribbons can be bonded by means of an adhesive or an adhesive strip 110, as shown in FIG. 8, applied in overlying bonded relationship and overlapping the adjacent edges of continuous ribbons 66', 76'. The adhesive strip 110 may conveniently be perforated, as indicated at 112 in FIG. 8, along the length thereof to facilitate separation of the individual packets at the time of ultimate use. The strip 110 may incorporate a coating of a pressure-sensitive adhesive thereon, or alternatively, may be coated with an adhesive prior to application to the edges of the continuous ribbon. It is also contemplated that an adhesive can be directly applied to the adjacent edges of the ribbons to effect an adherence thereof to each other along their abutting aligned edges. In either event, a bonding roll assembly 84 is employed to effect a synchronization and alignment of the plurality of continuous ribbons to assure transverse alignment between packets of adjacent ribbons and mutual abutting relationship of the lateral edges of adjacent ribbons.

Figure 9:
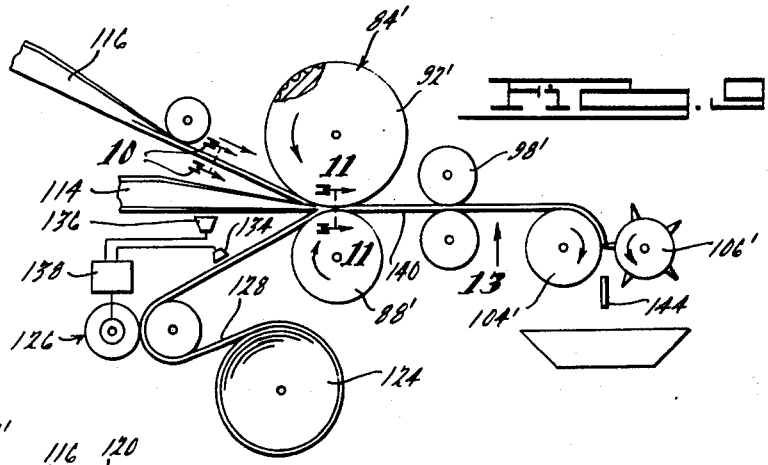
FIG. 9 is a fragmentary schematic side elevational view of an apparatus for making packet assemblies in accordance with an alternative embodiment of the present invention.

An alternative embodiment for making dispensing packet assemblies is illustrated in FIG. 9 in which like components are indicated by the same numeral with a prime affixed thereto. As shown in FIG. 9, a first continuous ribbon 114 and a second continuous ribbon 116, which are produced in a manner similar to that described in connection with FIG. 1, are fed into the bight portion of a bonding roll assembly 84' comprising a lower roll 88' and an upper roll 92', which is provided with a plurality of axially extending projections and recesses around the periphery thereof conforming to the fluted pattern of the packets on the continuous ribbons 114, 116.

Figure 10:
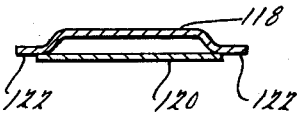
FIG. 10 is a transverse sectional view through one of the continuous ribbons employed in fabricating the composite ribbon as shown in FIG. 9 and taken substantially along the line 10—10 thereof.

As best seen in FIG. 10, each of the continuous ribbons comprises a fluted facing sheet 118 and a flat backing sheet or strip 120, wherein the width of the facing strip 118 is greater than the backing strip, such that the ribbon incorporates a laterally projecting edge portion 122 extending longitudinally along each lateral side edge thereof. As previously described, the lower surface of the fluted strip 118, as viewed in FIG. 10, is provided with a coating of a thermoplastic resin to enable heat sealing thereof.

Figure 11:
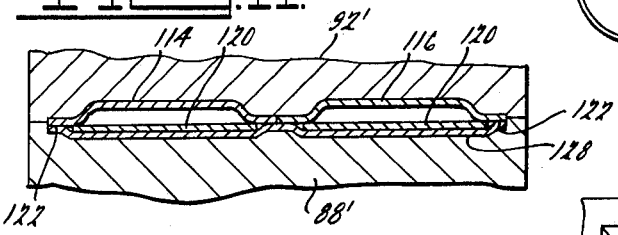
FIG. 11 is a fragmentary transverse vertical sectional view of the synchronizing and sealing roll assembly shown in FIG. 9 and as viewed substantially along lines 11—11 thereof.
Figure 12:
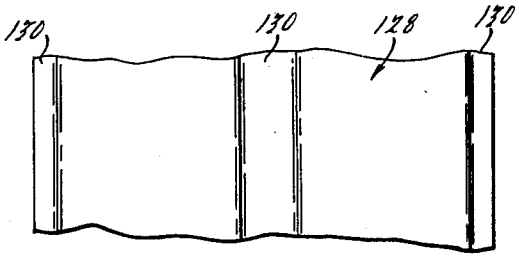
FIG. 12 is a fragmentary plan view of an imprinted web prior to bonding thereof to the aligned continuous ribbons.

A bonding of the continuous ribbons together to form a composite ribbon is achieved by introducing a third imprinted strip 128 into the bight section of the bonding roll assembly 84', which underlies the outer faces of the backing strips 120 of each of the continuous ribbons, as best seen in FIG. 11. The imprinted strip 128 is of a width equal to the transverse width of the two continuous ribbons and is provided on its upper surface with a coating of a thermoplastic resin which preferably is in the form of three longitudinally extending bands 130, as indicated in FIG. 12, to effect a heat sealing of the imprinted strip to the undersides of the edge portions 122 along each side of each ribbon. The upper roll 92' and lower roll 88' are provided with annular bands therearound to effect a compaction of the projecting edges and the bands along the imprinted strip to obtain a tenacious heat-sealed bond therebetween. The opposite face of the imprinted strip 128 is preferably provided with imprinted indicia, indicated at 132 in FIG. 13, which may be disposed at random intervals and preferably are disposed at fixed intervals corresponding to the longitudinal width of each of the packets.

As shown in FIG. 9, the imprinted strip 128 is continuously unwound from a feed roll 124 and passes between a braking roll assembly 126, which applies a controlled tensioning to the strip, effecting a controlled stretching thereof so as to maintain registration of the imprinted indicia 132 thereon relative to the packets of the continuous ribbons. A sensing of the relative disposition of the fluted pattern and the imprinted indicia in order to maintain appropriate registration is achieved by two optical sensors 134, 136, electrically connected to a circuit 138 which in turn supplies a controlled electrical current to the braking roll assembly in order to maintain registration of the several strips and ribbons. A device of this general type is disclosed in U.S. Pat. No. 3,276,183, granted Oct. 4, 1966, for "Register Control Device for Packaging Apparatus", which is assigned to the same assignee as the present invention. The substance of the aforementioned patent is incorporated herein by reference. It will be understood that when the imprinted indicia on the strip 128 are randomly disposed, no registration control device is required.

Figure 13:
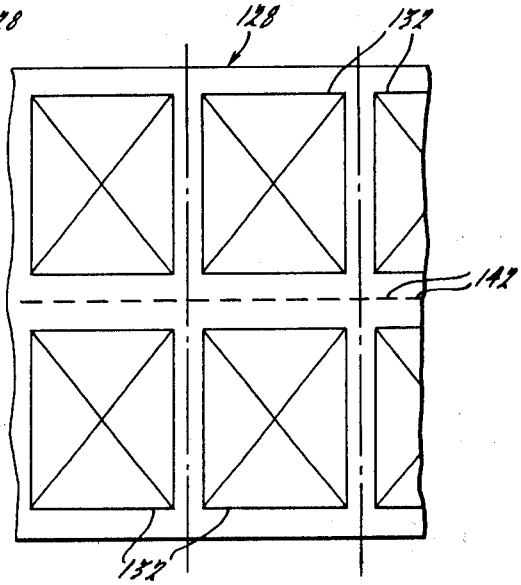
FIG. 13 is a plan view of the underside of the composite ribbon prior to severance into individual packet assemblies as viewed in the direction of the arrow 13 in FIG. 9.

In accordance with the foregoing arrangement, the two continuous ribbons 114, 116 and the strip 128 are united in the bonding roll assembly 84', forming a composite ribbon 140, as shown in FIG. 9, which preferably is perforated along the central longitudinally extending sealing band as indicated at 142 in FIG. 13, such as by means of a perforating wheel assembly 98', as shown in FIG. 9. The composite ribbon 140 thereafter passes between a backing roll 104' and a cutter roll 106', whereby the composite ribbon is severed along the transverse sealing bands into packet assemblies 144, comprising two interconnected packets 146, 148, supported and bonded to the imprinted strip 128, as best seen in FIG. 14.

It will also be understood that a bonding of the two continuous ribbons to the imprinted strip can be achieved employing a pressure-sensitive adhesive or quick-setting adhesive applied to the face of the imprinted strip and/or to the outer surfaces of the backing strips 120 of the continuous ribbons so as to effect an integral assembly upon passage through the bonding roll assembly.

Figure 14:
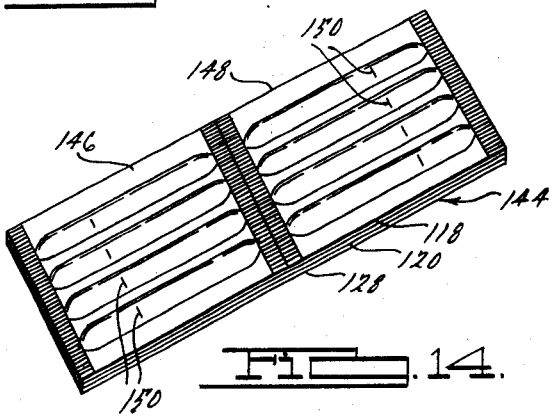
FIG. 14 is a perspective view of a dispensing packet assembly comprising two interconnected packets produced in accordance with the arrangement as shown in FIG. 9.

As will be noted in FIG. 14, the flutes of each of the packets 146, 148 may be provided with transverse slits or perforations, indicated at 150, to facilitate subsequent rupture of the packets for shaking or dispensing the contents therefrom at the time of ultimate use.

While it will be apparent that the invention herein described is well calculated to achieve the benefits and advantages set forth above, it will be appreciated that the invention is susceptible to modification, variation and change without departing from the spirit thereof.

What is claimed is:

1. In an apparatus for making disposable dispensing packet assemblies, the combination comprising means for forming a first continuous web comprised of a pair of opposed strips bonded in face-to-face relationship at longitudinally spaced intervals therealong defining a plurality of first cavities, means for filling said first cavities with a first material, means for sealing the filled said first cavities forming a first continuous ribbon comprised of a plurality of interconnected first packets, means for forming a second continuous web comprised of a pair of opposed strips bonded in face-to-face relationship at longitudinally spaced intervals therealong defining a plurality of second cavities, means for filling said second cavities with a second material, means for sealing the filled said second cavities forming a second continuous ribbon comprised of a plurality of interconnected second packets, means for orienting a lateral edge of said first ribbon and a lateral edge of said second ribbon in aligned adjacent relationship, means for transversely aligning said first packets and said second packets, means for bonding said first ribbon to said second ribbon with said first and said second packets in transversely aligned relationship forming a composite ribbon, and means for transversely severing said composite ribbon into sections each comprising a packet assembly consisting of an interconnected said first and said second packet.

2. The combination as defined in claim 1, in which said means for forming said first continuous web and said second continuous web include means for embossing one of the opposed strips in the form of a plurality of transversely extending flutes defining said first cavities and said second cavities, respectively.

3. The combination as defined in claim 1, in which said means for forming said first continuous web and said second continuous web include means for arranging said opposed strips such that the lateral edge of one of said strips projects beyond the lateral edge of the other trip forming a longitudinally extending exposed edge.

4. The combination as defined in claim 3, in which said means for orienting said first and said second ribbon include means for positioning said lateral exposed edge along said first ribbon in overlying relationship with respect to said lateral exposed edge along said second ribbon.

5. The combination as defined in claim 4, wherein said means for bonding said first and said second ribbon to each other include means for heat sealing the overlying lateral exposed edges along said first ribbon and said second ribbon together.

6. The combination as defined in claim 1, in which said means for forming said first and said second continuous web include means for arranging said opposed strips so that each lateral edge of one of said strips projects beyond the lateral edge of the other of said strips forming a pair of longitudinally extending exposed edges along each of the ribbons.

7. The combination as defined in claim 6, wherein said means for bonding said first and said second ribbon to each other includes means for introducing a third strip in overlying relationship with respect to said ribbons and heat sealing and bonding the longitudinally extending exposed edges thereof to said third strip.

8. The combination as defined in claim 1, further including means for perforating said composite ribbon longitudinally along the region of juncture between said first ribbon and said second ribbon to facilitate separation of said first packet from said second packet.

9. A method for making disposable packet assemblies which comprises the steps of forming a first continuous web comprised of a pair of opposed strips bonded in face-to-face relationship at longitudinally spaced intervals therealong defining a plurality of first cavities, filling said first cavities with a first material, sealing the filled said first cavities forming a first continuous ribbon comprised of a plurality of interconnected first packets, forming a second continuous web comprised of a pair of opposed strips bonded in face-to-face relationship at longitudinally spaced intervals therealong defining a plurality of second cavities, filling said second cavities with a second material, sealing the filled said second cavities forming a second continuous ribbon comprised of a plurality of interconnected second packets, orienting a lateral edge of said first ribbon and a lateral edge of said second ribbon in aligned adjacent relationship, transversely aligning said first packets and said second packets, bonding said first ribbon to said second ribbon with said first and said second packets in transversely aligned relationship forming a composite ribbon, and transversely severing said composite ribbon into sections comprising a packet assembly consisting of an interconnected first and second packet.

* * * * *